US008839803B2

(12) United States Patent
Holloway

(10) Patent No.: US 8,839,803 B2
(45) Date of Patent: Sep. 23, 2014

(54) ROTATIONALLY CONTROLLED COSMETIC POWDER DOSE DISPENSER

(76) Inventor: Thomas F. Holloway, Southbury, CT (US)

( * ) Notice: Subject to any disclaimer, the term of this patent is extended or adjusted under 35 U.S.C. 154(b) by 0 days.

(21) Appl. No.: 13/016,675

(22) Filed: Jan. 28, 2011

(65) Prior Publication Data

US 2012/0090637 A1 Apr. 19, 2012

Related U.S. Application Data

(60) Provisional application No. 61/299,205, filed on Jan. 28, 2010, provisional application No. 61/382,983, filed on Sep. 15, 2010.

(51) Int. Cl.
*A45D 33/16* (2006.01)
*A45D 33/02* (2006.01)
*A45D 33/08* (2006.01)

(52) U.S. Cl.
CPC ..... *A45D 33/02* (2013.01); *A45D 33/16* (2013.01); *A45D 33/08* (2013.01)
USPC ..... 132/307; 132/299; 132/298; 222/142.9; 222/548

(58) Field of Classification Search
CPC ..... A45D 33/02; A45D 33/08; A45D 33/16
USPC ..... 132/293, 295, 298, 299, 300, 303, 305, 132/306, 307; 206/823, 581, 223, 229, 235, 206/385; 222/142.9, 480, 548, 565
See application file for complete search history.

(56) References Cited

U.S. PATENT DOCUMENTS

| | | | | | |
|---|---|---|---|---|---|
| 938,161 | A * | 10/1909 | Messinger | 222/480 |
| 1,156,456 | A * | 10/1915 | Beck | 132/298 |
| 1,642,780 | A * | 9/1927 | Lessing et al. | 132/295 |
| 2,460,444 | A * | 2/1949 | Bering | 132/299 |
| 5,148,941 | A * | 9/1992 | Chezek | 220/4.26 |
| 5,305,931 | A * | 4/1994 | Martin et al. | 222/480 |
| 5,669,400 | A * | 9/1997 | Sheffler et al. | 132/295 |
| 6,053,183 | A * | 4/2000 | Rizzo | 132/307 |
| 6,138,687 | A * | 10/2000 | Sheffler et al. | 132/295 |
| 6,193,116 | B1 * | 2/2001 | Sheffler et al. | 222/480 |
| 6,200,047 | B1 * | 3/2001 | Holloway | 401/75 |
| 7,494,030 | B2 * | 2/2009 | Bennett | 222/480 |
| 7,845,525 | B2 * | 12/2010 | Lantz et al. | 222/507 |
| 8,025,067 | B2 * | 9/2011 | Thorpe et al. | 132/307 |
| 8,066,019 | B2 * | 11/2011 | Zhu et al. | 132/299 |
| 8,118,040 | B2 * | 2/2012 | Bennett | 132/307 |
| 8,132,578 | B2 * | 3/2012 | LoPrete | 132/307 |

(Continued)

*Primary Examiner* — Robyn Doan
*Assistant Examiner* — Tatiana Nobrega
(74) *Attorney, Agent, or Firm* — O'Connell Law Firm; Thomas P. O'Connell

(57) ABSTRACT

A rotationally controlled cosmetic powder dose dispenser with a sifter cup pivotally retained by a sifter housing. Opposed arcuate slots are disposed in the bottom wall of the sifter housing and first and second series of apertures are disposed in opposed arcuate configurations in the bottom wall of the sifter cup. The series of apertures and the arcuate slots can be selectively aligned to dispense a volume of cosmetic powder into a sifter jar that is removably coupled to the sifter housing. The sifter housing has a rim received between an outer cylindrical wall and a peripheral wall of the sifter cup, and the sifter jar has a rim received between an outer cylindrical wall and a peripheral wall of the sifter housing in a threaded engagement.

12 Claims, 15 Drawing Sheets

(56) References Cited

U.S. PATENT DOCUMENTS

| | | | | |
|---|---|---|---|---|
| 8,181,828 | B2 * | 5/2012 | Deans | 222/282 |
| 8,210,187 | B1 * | 7/2012 | Zhang | 132/299 |
| 2008/0178903 | A1 * | 7/2008 | Thorpe et al. | 132/307 |
| 2008/0185013 | A1 * | 8/2008 | Abergel et al. | 132/200 |
| 2009/0001104 | A1 * | 1/2009 | Ranney | 222/438 |
| 2009/0272400 | A1 * | 11/2009 | Park et al. | 132/298 |
| 2010/0096410 | A1 * | 4/2010 | Deans | 222/182 |
| 2011/0048443 | A1 * | 3/2011 | Pires et al. | 132/200 |

* cited by examiner

ROTATIONALLY CONTROLLED COSMETIC POWDER DOSE DISPENSER

PRIORITY

Provisional Application No. 61/299,205, filed Jan. 28, 2010, and Provisional Application No. 61/382,983, filed Sep. 15, 2010

FIELD OF THE INVENTION

The present invention relates generally to cosmetic dispensers. More particularly, disclosed herein is a cosmetic powder dispenser that retains cosmetic powder within a housing and selectively dispenses powder in doses.

BACKGROUND OF THE INVENTION

Numerous cosmetic powder dispensers have been disclosed by the prior art. Devices have been taught where a jar that simply retains a volume of powder. Other devices include a sifter with the goal of controlling the flow of powder from an inner volume of the dispenser. Historically, these devices have many drawbacks, which have been recognized in the art.

For example, powder is often not dispensed at a controlled rate, allowing either too little or too much powder to be emitted with each dispensing operation. Another common problem under the prior art is the tendency dispensing devices to allow product to continue to flow even after the desired amount of product has been dispensed. Consequently, cosmetic product may leak or spill out of the device, particularly during transportation from one location to another as is necessary for permitting reapplication during a given day or evening. This unintentional dispensing of the potentially valuable cosmetic powder results in wasted cosmetic product and messiness. Still further, many previously disclosed dispensers require that the dispenser be essentially disassembled and reassembled to obtain each dose of powder.

With a knowledge of these and further deficiencies of the prior art, it has become clear to the present inventor that there is a need for a cosmetic powder dispenser that overcomes the problems of prior art dispensers, including by permitting repeated doses of powder to be dispensed conveniently, efficiently, and predictably without undue disassembly, reassembly, or other excessive manipulation of the device while avoiding messiness and wasted cosmetic product.

SUMMARY OF THE INVENTION

The present invention is thus founded on the basic object of providing a cosmetic powder dispenser that dispenses doses of cosmetic powder conveniently, efficiently, and with a level of predictability.

A further object of embodiments of the invention is to provide a cosmetic powder dose dispenser that dispenses doses of cosmetic powder with reduced messiness.

Another object of embodiments of the invention is to provide a cosmetic powder dose dispenser that dispenses doses of cosmetic powder with minimal waste of cosmetic product.

Yet another object of embodiments of the invention is to provide a cosmetic powder dose dispenser that can dispense multiple doses of cosmetic powder without a need for excessive manipulation of the dispenser.

An additional object of embodiments of the invention is to provide a cosmetic powder dose dispenser that is portable and easy to use.

A further object of embodiments of the invention is to provide a cosmetic powder dose dispenser that is capable of retaining and dispensing various cosmetic powders, including blushes, bronzers, eye shadows, and foundations.

These and further objects and advantages of embodiments of the invention will become obvious not only to one who reviews the present specification and drawings but also to one who has an opportunity to make use of an embodiment of the invention for a rotationally controlled cosmetic powder dispenser disclosed herein. The accomplishment of each of the foregoing and possibly further objects in a single embodiment of the invention may be possible and indeed preferred. However, it will be appreciated that not all embodiments will seek or need to accomplish each and every potential object and advantage. Nonetheless, all such embodiments should be considered within the scope of the present invention.

In carrying forth the foregoing objects, an embodiment of the present invention for a rotationally controlled cosmetic powder dose dispenser employs a sifter housing in combination with a sifter cup pivotally retained by the sifter housing to retain and dispense a volume of cosmetic powder from the open inner volume of the sifter cup into a sifter jar that is removably coupled to the sifter housing. At least one aperture is disposed in the bottom wall of the sifter housing and at least one aperture is disposed in the bottom wall of the sifter cup. The at least one aperture in the bottom wall of the sifter cup can be selectively disposed in alignment with the at least one aperture in the bottom wall of the sifter housing to permit a volume of cosmetic powder to be dispensed from the open inner volume of the sifter cup. The at least one aperture in the bottom wall of the sifter cup can be selectively disposed out of alignment with the at least one aperture in the bottom wall of the sifter housing to prevent cosmetic powder from being dispensed from the open inner volume of the sifter cup. The sifter jar has an open inner volume for receiving the cosmetic powder dispensed from the open inner volume of the sifter cup. A cap can be selectively engaged with the sifter cup to retain cosmetic powder in the open inner volume of the sifter cup.

In certain embodiments, there can be a plurality of apertures disposed in the bottom wall of the sifter cup and a plurality of apertures disposed in the bottom wall of the sifter housing with the pluralities of apertures in the bottom walls of the sifter cup and the sifter housing selectively disposed in alignment based on a relative pivoting between the sifter cup and the sifter housing. The at least one aperture in the bottom wall of the sifter housing preferably defines an arcuate configuration and the at least one aperture in the bottom wall of the sifter cup defines an arcuate configuration disposed to align selectively with the arcuate configuration of the at least one aperture in the bottom wall of the sifter housing. For example, the at least one aperture in either the sifter housing and the sifter cup can comprise a series of apertures disposed in an arcuate configuration and the at least one aperture in the other of the sifter housing and the sifter cup can comprise an arcuate slot. Still further, in particular embodiments there can be first and second slots disposed in the bottom wall of the sifter housing and first and second series of apertures in the bottom wall of the sifter cup.

The sifter housing can have an annular ridge, and the sifter cup can have a sifter rim defined by a radially communicating ring and a downturned outer cylindrical wall generally concentric with the peripheral wall of the sifter cup to define a torroidal shape. Under that configuration, the annular ridge of the sifter housing can be received into the torroidal shape defined by the outer cylindrical wall and the peripheral wall. Additionally, the sifter housing can have a shoulder ring that projects radially from a mid-portion of the peripheral wall and an outer cylindrical wall that projects from the outer edge of the shoulder ring to define a torroidal shape between the outer cylindrical wall and the peripheral wall of the sifter housing. The annular ridge of the sifter jar can be threadedly engaged with the torroidal shape of the sifter housing defined by the outer cylindrical wall and the peripheral wall.

Where the sifter cup is pivotable from a first orientation position to a second orientation position relative to the sifter housing, a stop member, which can project from the sifter cup and into the arcuate slot in the sifter housing, can act as a means for limiting pivoting of the sifter cup from pivoting beyond the first and second positions. The at least one aperture in the bottom wall of the sifter housing and the at least one aperture in the bottom wall of the sifter cup can each be considered to have a lead end and a trailing end and span a given arc length with the arc length of the arcuate slot being greater than the arc length of the series of apertures.

Under particular manifestations of the invention, a raised semicircular ridge can be disposed on a distal edge of the peripheral wall of the sifter housing. The raised semicircular ridge can have first and second ends separated by an open arc, and a sifter lever that projects radially from the sifter cup can ride on the distal edge of the sifter housing within the open arc between the ends of the semicircular ridge. Moreover, means can be provided for restraining the sifter lever and, derivatively, the sifter cup against inadvertent pivoting. For example, the means for restraining the sifter lever against inadvertent pivoting can take the form of a protuberance that projects from one of the sifter lever and the distal edge of the peripheral wall of the sifter housing and a notch on the other of the sifter lever and the distal edge of the peripheral wall of the sifter housing.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

The invention may be more completely understood with reference to the accompanying drawings, in which.

DETAILED DESCRIPTION OF PREFERRED EMBODIMENTS

Figure 1:
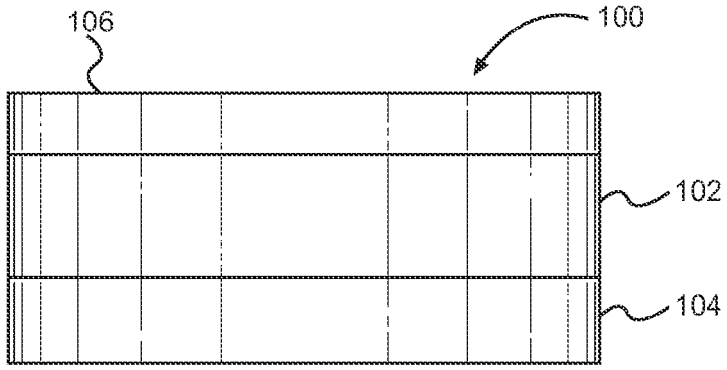
FIG. 1 is a view in front elevation of a rotationally controlled cosmetic powder dose dispenser according to the invention.
Figure 2:
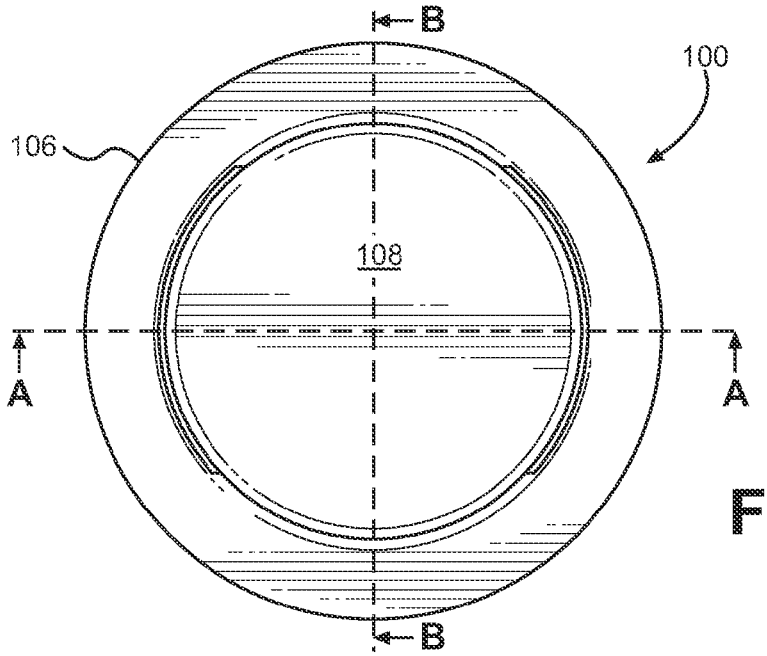
FIG. 2 is a top plan view of the rotationally controlled cosmetic powder dose dispenser of FIG. 1.
Figure 3:
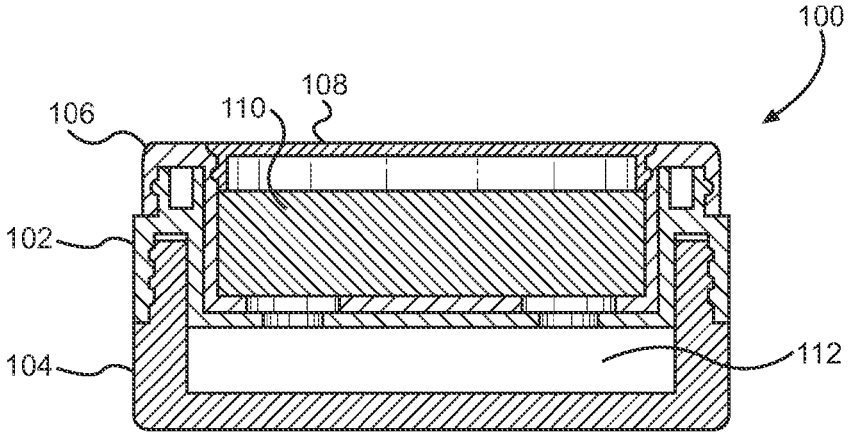
FIG. 3 is a cross-sectional view of the rotationally controlled cosmetic powder dose dispenser taken along the line A-A in FIG. 2.
Figure 4:
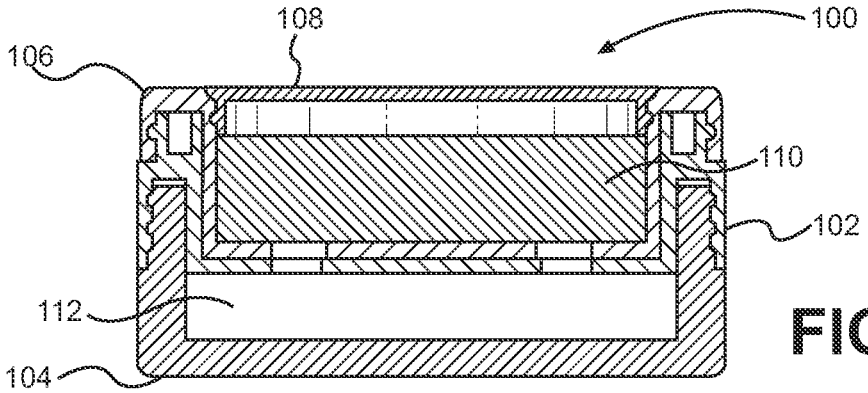
FIG. 4 is a cross-sectional view of the rotationally controlled cosmetic powder dose dispenser taken along the line B-B in FIG. 2.

It will be appreciated that the rotationally controlled cosmetic powder dose dispenser disclosed herein is subject to widely varied embodiments. However, to ensure that one skilled in the art will be able to understand and, in appropriate cases, practice the present invention, certain preferred embodiments of the broader invention revealed herein are described below and shown in the accompanying drawing figures.

It will be appreciated that the present discussion relates primarily to devices for enabling the retention and dispensing of cosmetic powders. However, the dispenser device disclosed herein is not so limited. It may find useful application in other industries beyond the field of cosmetics. The protection afforded the invention should be limited only as may be expressly required by the claims.

Looking more particularly to the drawings, an embodiment of the cosmetic powder dose dispenser disclosed herein is indicated generally at 100 in FIGS. 1 through 6. There, the cosmetic powder dose dispenser 100 can be seen to have what can be referred to as a lower sifter housing 102 pivotally coupled to a sifter cup 106 for dispensing measured doses of cosmetic product 110 retained within the sifter cup 106 through sifting apertures 116 in the sifter cup 106 and dispensing slots 114 in the lower sifter housing 102 and into an open inner volume 112 of a sifter jar 104 when the sifting apertures 116 and the dispensing slots 114 are aligned. The various components of the rotationally controlled cosmetic powder dose dispenser 100 are shown apart in FIGS. 7 through 15 to ensure that the reader will have an accurate and complete appreciation for the structure, function, and advantages of the dispenser 100 disclosed herein.

A further understanding of the sifter cup 106 component of the powder dispenser 100 can be had by looking additionally to FIGS. 8 through 12 where the sifter cup 106 is shown alone. There, the sifter cup 106 is shown to have an open inner volume defined by a cylindrical peripheral wall 125 in cooperation with a sifter bottom panel 132. The sifter cup 106 has a sifter rim 128 defined by a radially communicating ring and a downturned outer cylindrical wall generally concentric with the peripheral wall 125. An annular retaining channel 134 is disposed along the inner face of the outer cylindrical wall of the sifter rim 128 for engaging an annular retaining ridge 144 on the lower sifter housing 102 in a snap fit engagement.

A ring channel 130 is disposed in the bottom panel 132 of the sifter cup 106, and the sifting apertures 116 are disposed in series in the ring channel 130. More particularly, first and second series of sifting apertures 116, each comprising four evenly spaced through-holes, are disposed in opposite arcs in the ring channel 130. Each series of apertures 116 can be considered to have a lead end and a trailing end and to span a given arc length. A stop member 120 projects from the lower surface of the sifter bottom panel 132 marginally past the trailing end of each series of sifting apertures 116.

Figure 13:
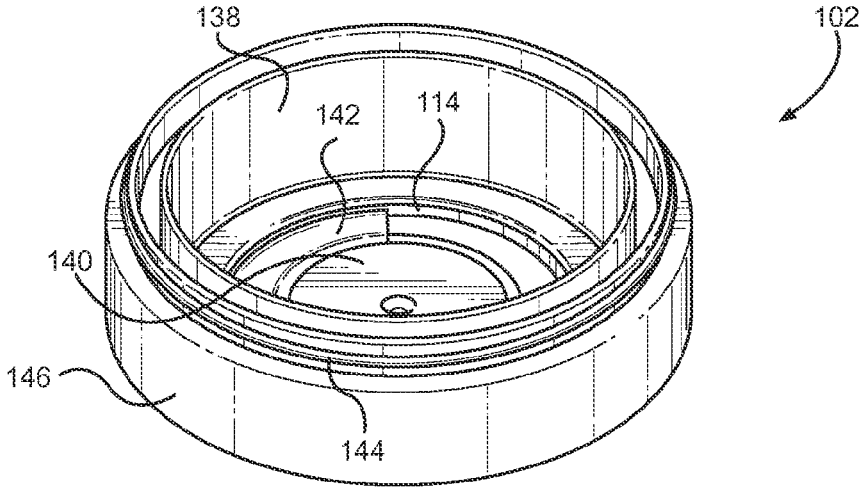
FIG. 13 is a perspective view of a lower sifter cap of the rotationally controlled cosmetic powder dose dispenser.
Figure 14:
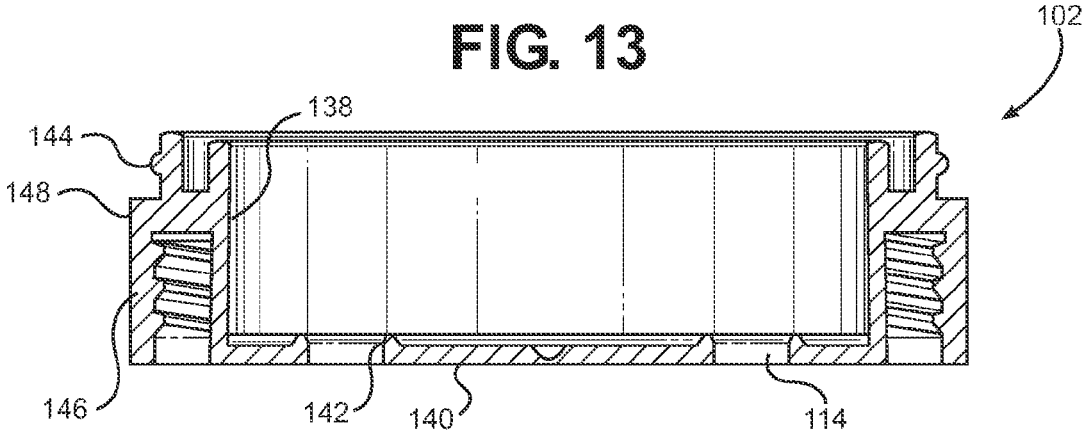
FIG. 14 is a cross-sectional view of the lower sifter cap of the rotationally controlled cosmetic powder dose dispenser.
Figure 15:
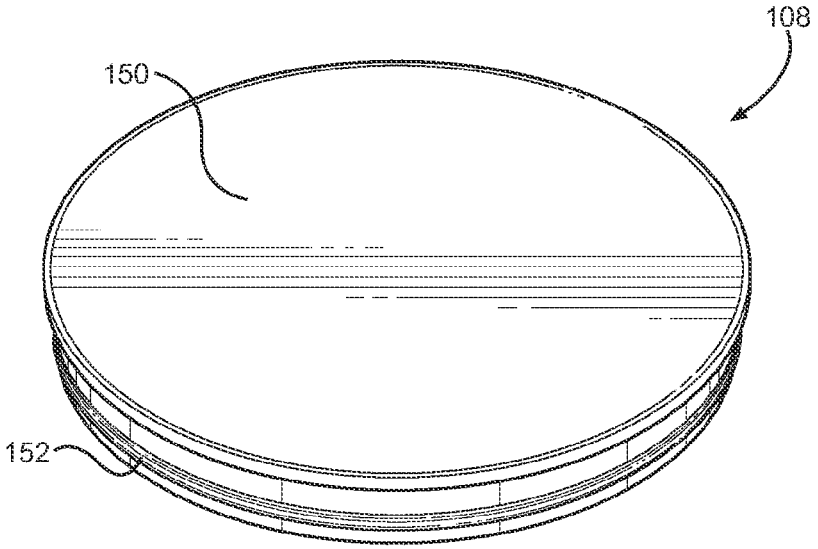
FIG. 15 is a perspective view of an upper sifter cap of the rotationally controlled cosmetic powder dose dispenser as taught herein.

The lower sifter housing 102 component of the cosmetic dispenser 100 is shown alone in FIGS. 13 and 14. The lower sifter housing 102 has a peripheral wall 138 that cooperates with a bottom 140 of the lower sifter housing 102 to define an open inner volume for receiving the sifter cup 106 in a mating relationship as shown, for example, in FIGS. 1, 3, and 4. First and second dispensing slots 114 are disposed in opposition in the bottom 140 of the lower sifter housing 102 along a ring shape matching the ring shape of the ring channel 130 in the bottom panel 132 of the sifter cup 106 within which the series of sifting apertures 116 are disposed. Each dispensing slot 114 has an arc length slightly greater than the arc length of the corresponding series of apertures 116, and the ring shape in which the slots 114 are disposed has opposed closed portions 142 having an arc length longer than the arc length of the series of apertures 116.

Figure 5:
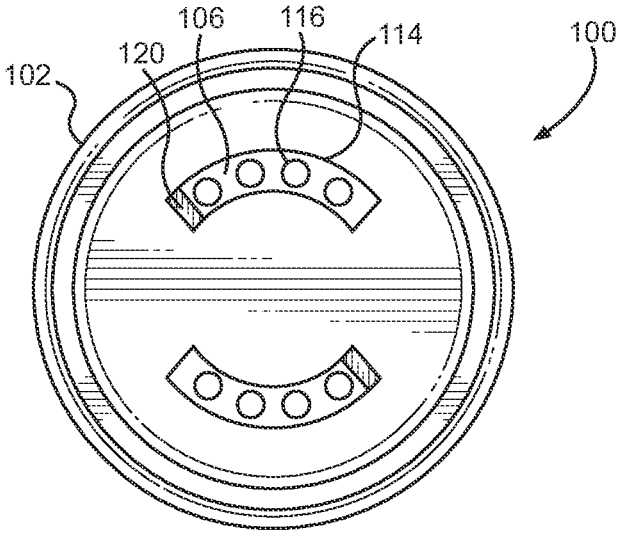
FIG. 5 is a bottom plan view of the rotationally controlled cosmetic powder dose dispenser in a dispensing configuration.
Figure 6:
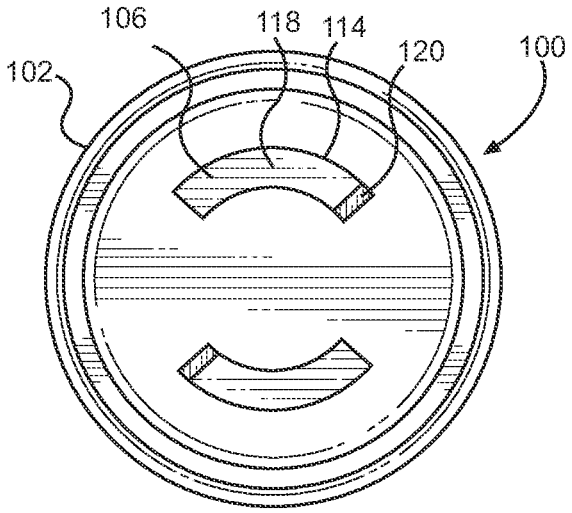
FIG. 6 is a bottom plan view of the rotationally controlled cosmetic powder dose dispenser in a non-dispensing configuration.
Figure 7:
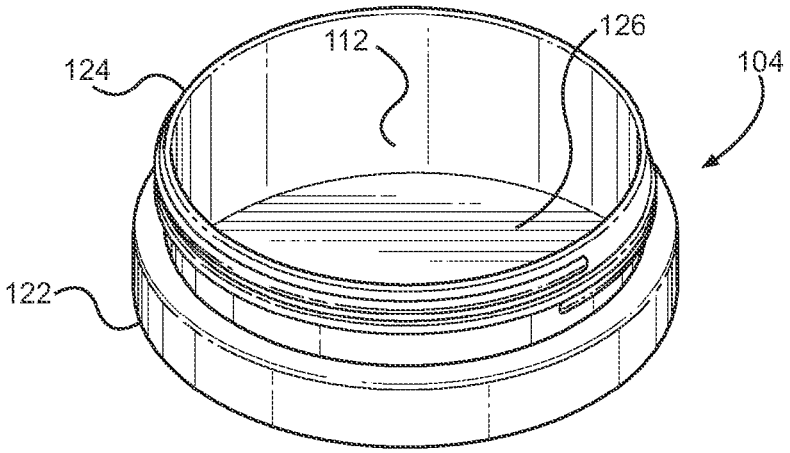
FIG. 7 is a perspective view of a sifter jar of the rotationally controlled cosmetic powder dose dispenser.
Figure 8:
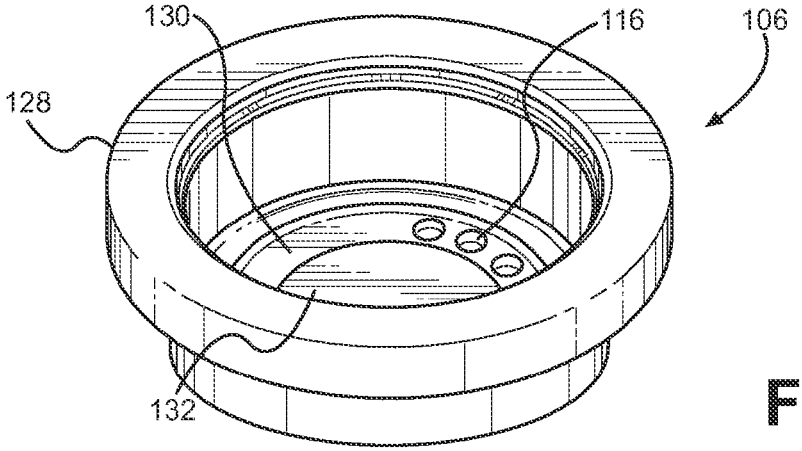
FIG. 8 is a perspective view of a sifter of the rotationally controlled cosmetic powder dose dispenser.
Figure 9:
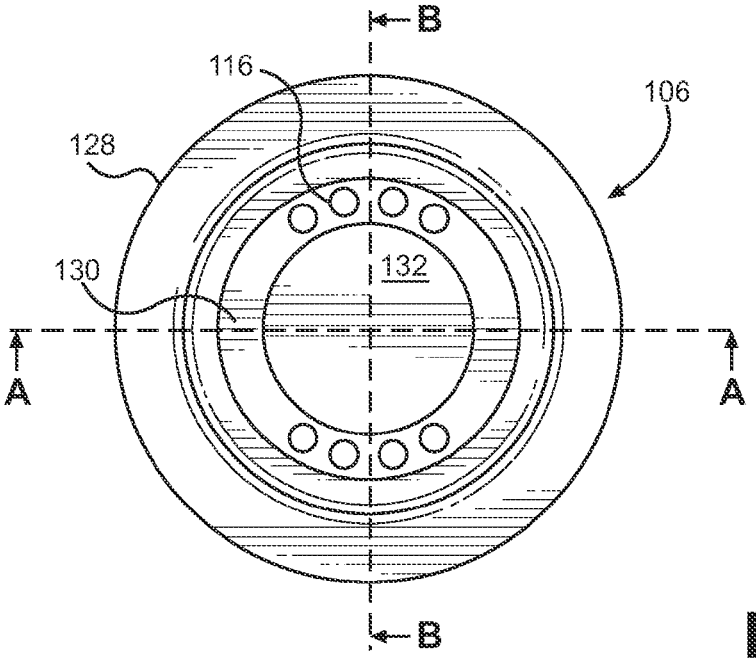
FIG. 9 is a top plan view of the sifter of the rotationally controlled cosmetic powder dose dispenser.
Figure 10:
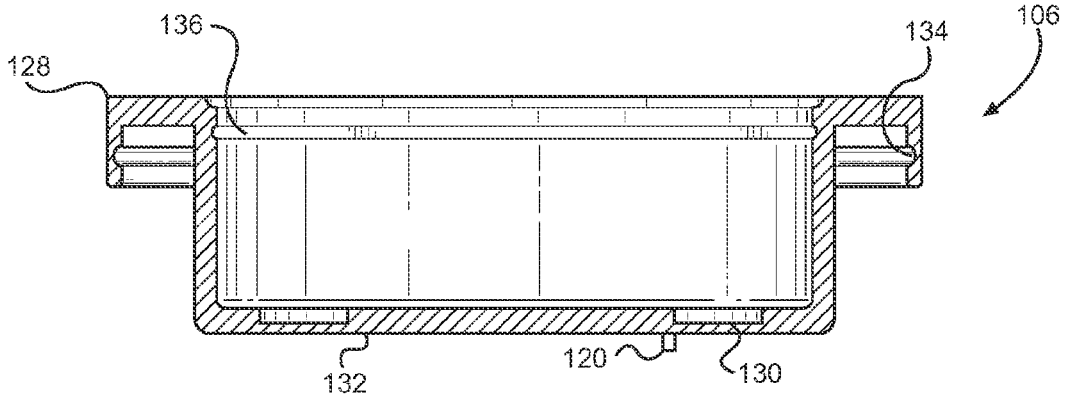
FIG. 10 is a cross-sectional view of the sifter of the rotationally controlled cosmetic powder dose dispenser taken along the line A-A in FIG. 9.
Figure 11:
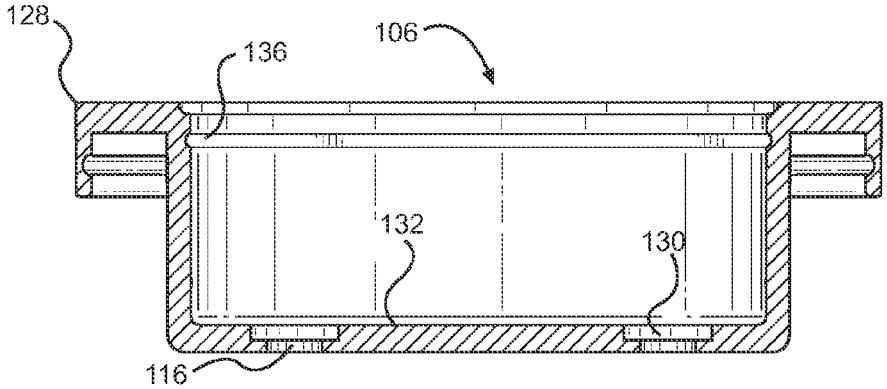
FIG. 11 is a cross-sectional view of the sifter of the rotationally controlled cosmetic powder dose dispenser taken along the line B-B in FIG. 9.
Figure 12:
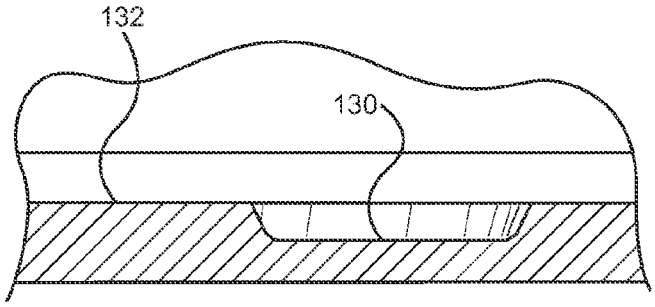
FIG. 12 is an enlargement of the encircled portion of the sifter of the rotationally controlled cosmetic powder dose dispenser of FIG. 11.

With this, the series of apertures 116 can be entirely exposed in relation to the lower sifter housing 102 when the slots 114 are aligned with them, and the series of apertures 116 can be entirely covered or sealed when the opposed closed portions 142 in the bottom 140 of the lower sifter housing 102 are disposed in alignment with the series of apertures 116. When the lower sifter housing 102 and the sifter cup 106 are matingly engaged, the stop members 120 project from the sifter bottom panel 132 of the sifter cup 106 through the slots 114 of the lower sifter housing 102. With this, the sifter cup 106 can be pivoted from a first stop position where the stop members 120 contact lead ends of the slots 114 and the apertures 116 are open as shown in FIG. 5 to a second position where the stop members 120 contact trailing ends of the slots 114 and the apertures 116 are closed as shown in FIG. 6 where closed portions 118 in the ring shape of the ring channel 130, which is seen in FIG. 8, in the bottom panel 132 of the sifter cup 106 align with the slots 114

A shoulder ring 148 projects radially from the peripheral wall 138 of the lower sifter housing 102 at a mid-portion thereof to a diameter substantially equal to the outer diameter of the sifter cup 106. An upper annular wall 145 projects upwardly from a mid-portion of the shoulder ring 148, and the annular, upstanding retaining ridge 144 is disposed thereon for engaging the annular retaining channel 134 in the sifter rim 128. An outer cylindrical wall 146 projects downwardly from the outer edge of the shoulder ring 148 to define a torroidal shape between it and the peripheral wall 138. The inner annular surface of the outer cylindrical wall 146 is threaded for engaging the correspondingly threaded rim 124 of the sifter jar 104, which is shown apart in FIG. 7.

The sifter jar 104 has a peripheral wall 115 that cooperates with a jar bottom 126 of the sifter jar 104 to define the open inner volume 112. A base cup portion 122 of the sifter jar 104 is broadened to an outer diameter approximately equal to the outer diameter of the lower sifter housing 102 and the sifter cup 106. As noted above, the peripheral wall 115 of the sifter jar 104 has the threaded rim 124, which can be threadedly engaged with the threaded inner surface of the outer cylindrical wall 146 of the lower sifter housing 102.

Finally, an upper sifter cap 108 is employed to selectively seal the open inner volume of the sifter cup 106 to retain the cosmetic product 110 therein. The upper sifter cap 108 has a flat lid portion 150 and an annular retaining ridge 152 along the periphery thereof. The annular retaining ridge 152 can engage the annular retaining channel 136 disposed on the upper inner surface of the peripheral wall 125 of the sifter cup 106. With this, the upper sifter cap 108 can engage the sifter cup 106 in a snap fit engagement.

With the various components as described, the cosmetic powder dose dispenser 100 can be assembled to achieve the configuration shown in FIGS. 1 through 6. The sifter cup 106 is snap fit from above into mating engagement with the lower sifter housing 102, the sifter jar 104 is threadedly engaged from below with the lower sifter housing 102, and the upper sifter cap 108 is snap fit into engagement with the sifter cup 106 from above.

A volume of cosmetic product 110 disposed in the open inner volume of the sifter cup 106 can thus be selectively dispensed into the open inner volume 112 of the sifter jar 104 by a relative pivoting of the lower sifter housing 102 in relation to the sifter cup 106. Where the sifter cup 106 is pivoted to have one or more of the sifting apertures 116 partially or completely aligned with the dispensing slots 114 and the dispenser 100 disposed in a generally upright configuration, cosmetic product 110 will fall through the apertures 116, through the slots 114, and into the open inner volume 112 of the sifter jar 104. The greater the pivoting, the more of a given aperture 116 or the greater the number of apertures 116 that will align with the slots 114. When a desired amount of product 110 has been dispensed, the sifter cup 106 can be pivoted oppositely to have all sifting apertures 116 shielded by the opposed solid portions of the lower sifter cap bottom 140. With a desired volume of cosmetic product 110 now disposed in the open inner volume 112 of the sifter jar 104, the sifter jar 104 can then be unthreaded from the lower sifter housing 102, and the cosmetic product 110 can be applied as desired.

Figure 16:
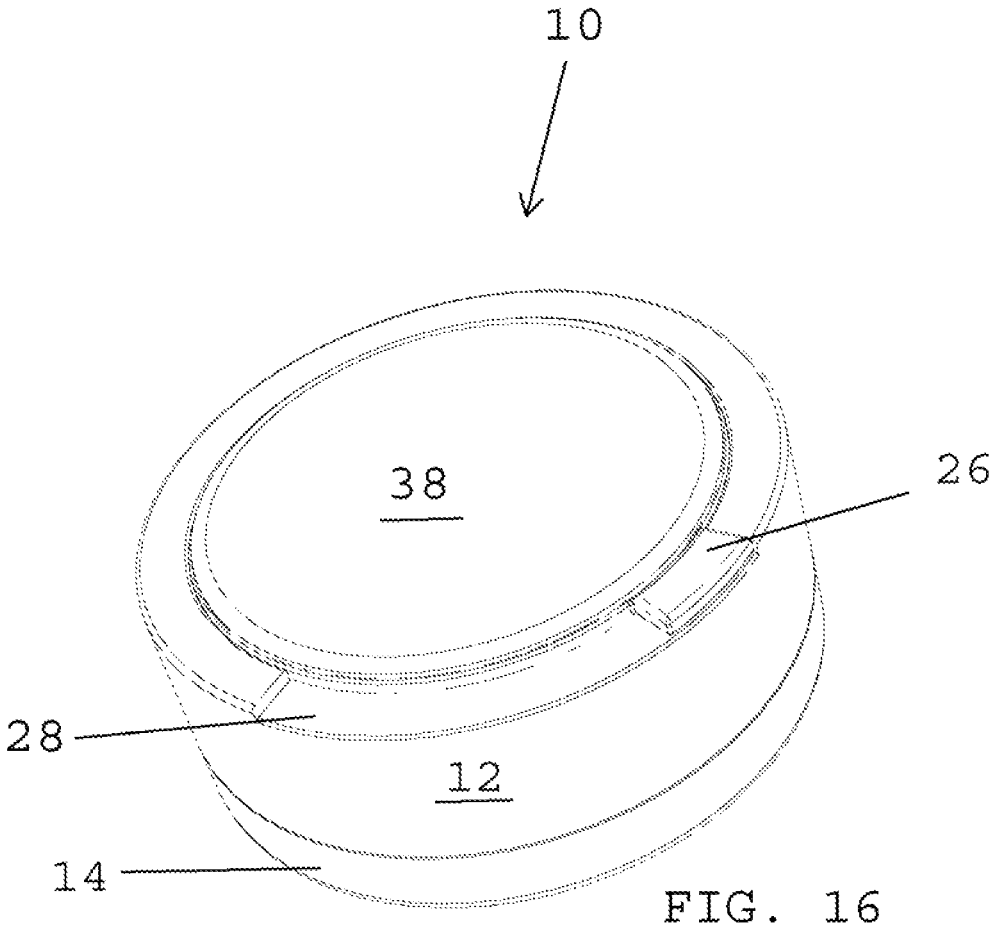
FIG. 16 is a perspective view of an alternative cosmetic powder dose dispenser pursuant to the present invention.
Figure 17:
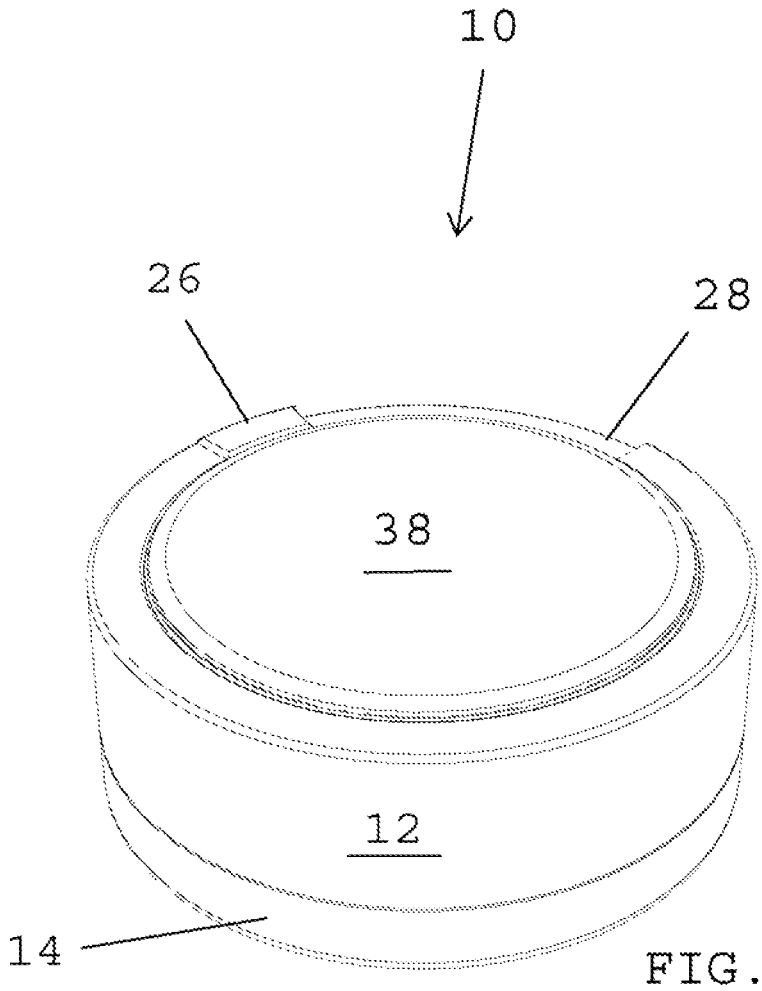
FIG. 17 is a further perspective view of the cosmetic powder dose dispenser of FIG. 16.
Figure 18:
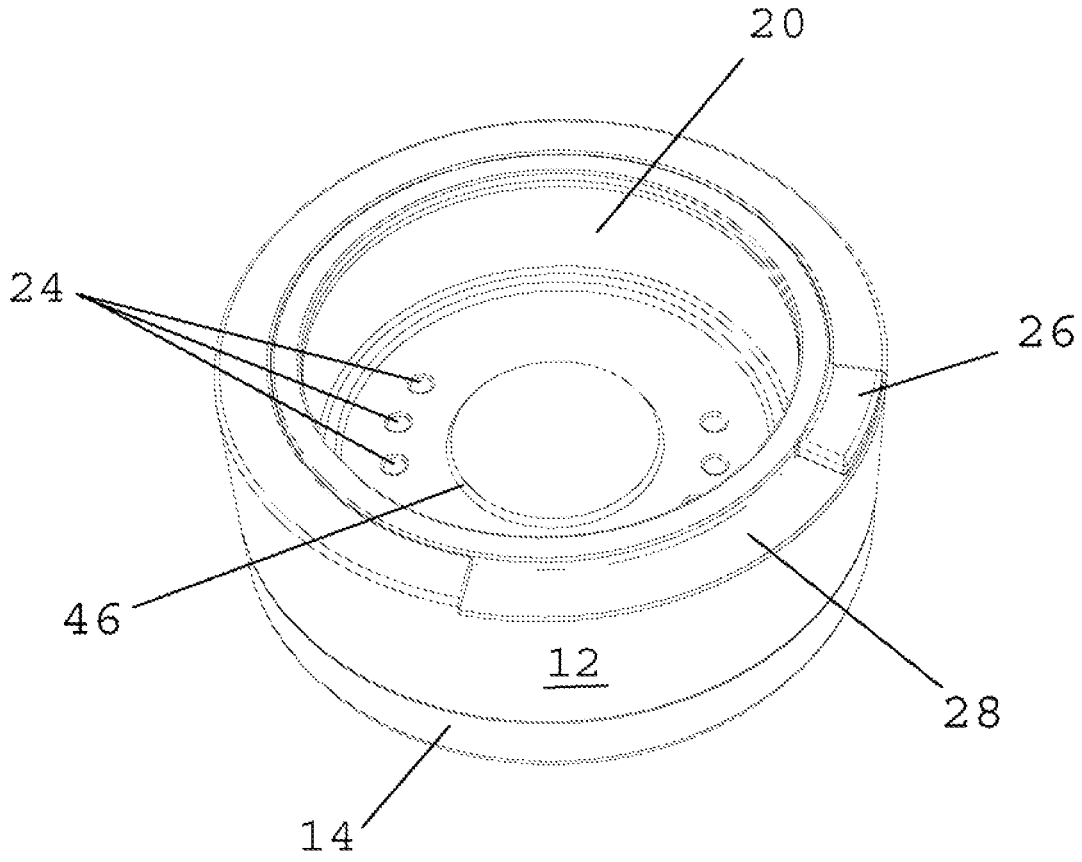
FIG. 18 is a perspective view of the cosmetic powder dose dispenser of FIG. 16 empty of cosmetic product and with the top cap removed.
Figure 20:
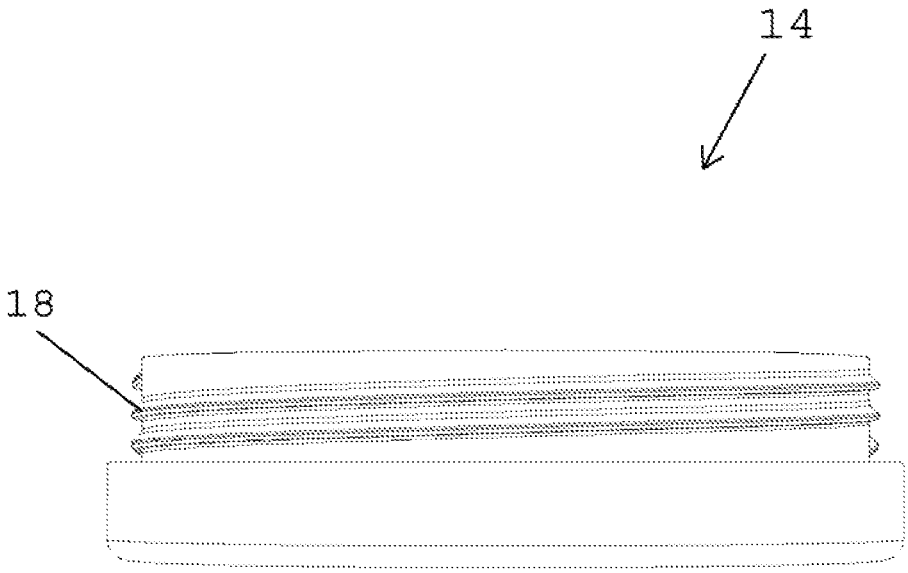
FIG. 20 is a view in front elevation of the cup portion of the cosmetic powder dose dispenser of FIG. 16.
Figure 21:
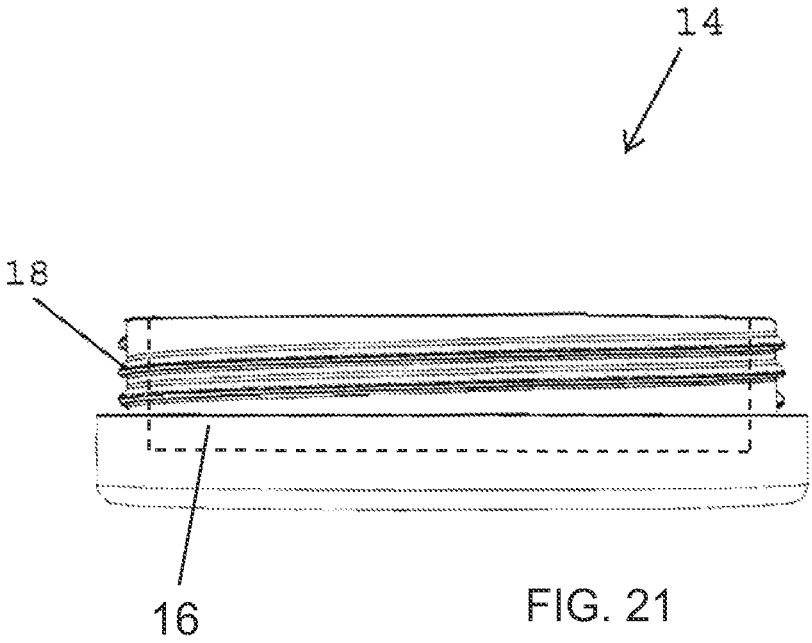
FIG. 21 is a view in front elevation of the cup portion of the cosmetic powder dose dispenser of FIG. 16.

It will again be noted that the rotationally controlled cosmetic powder dose dispenser disclosed herein is subject to varied embodiments within the scope of the invention. One alternative embodiment of the powder dispenser is indicated generally at 10 in FIGS. 16 and 17. The powder dispenser 10 is founded on a housing 12, which is shown apart in FIGS. 19 and 21. The housing 12 preferably has a circular shape. A cup 14, which is shown apart in FIGS. 20 and 21, is rotatably engaged with the bottom of the housing 12. The housing 12 and the cup 14 can be made of any suitably rigid material, such as plastic. The cup 14 in this embodiment has a flat bottom and a concave inner container 16, which can be perceived in FIG. 21. The cup 14 detaches from the bottom of the housing 12 by any effective arrangement, such as by way of threads 18 whereby one can unscrew the cup 14 from the housing 12.

Figure 19:
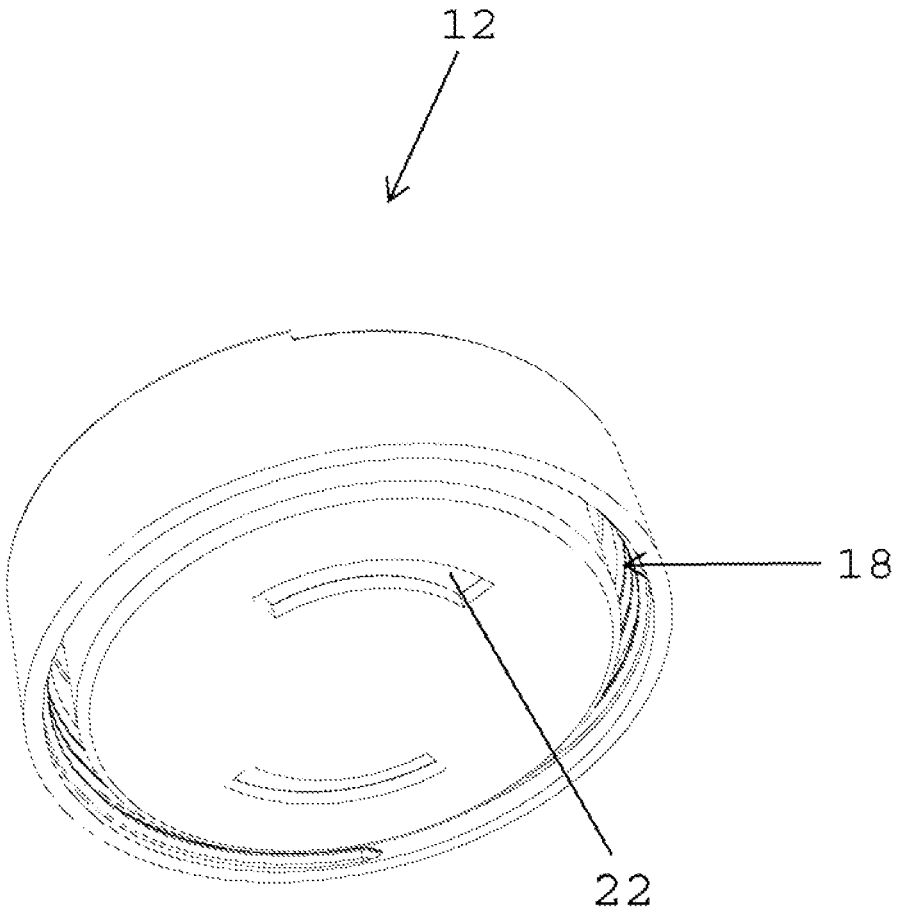
FIG. 19 is a lower perspective view of the housing portion of the cosmetic powder dose dispenser of FIG. 16.
Figure 22:
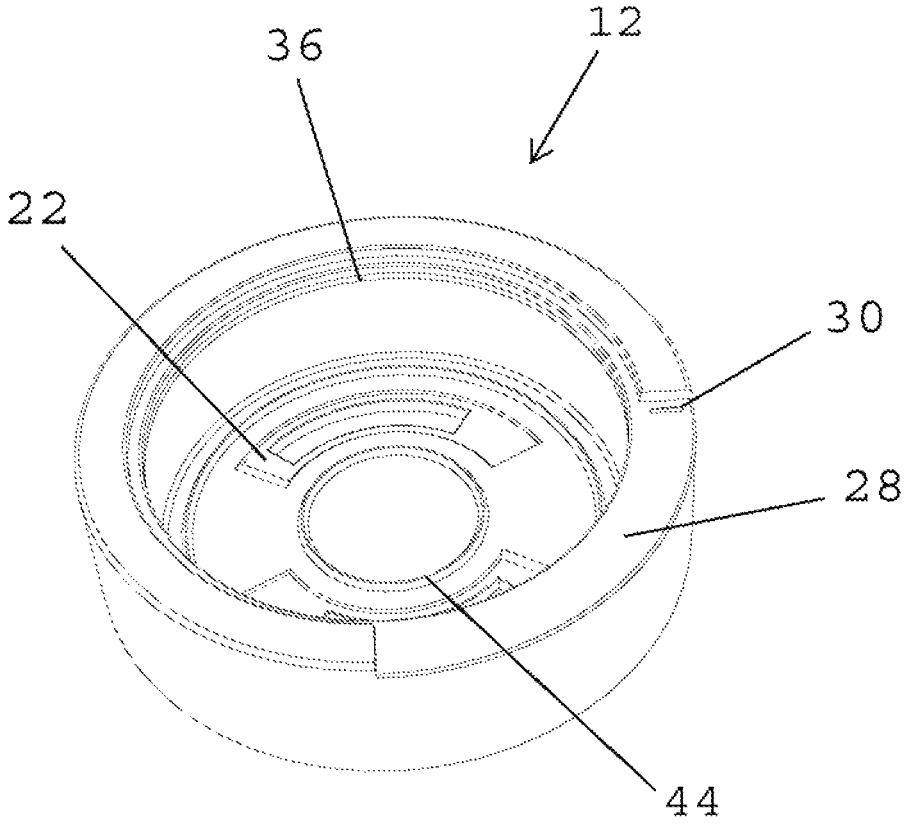
FIG. 22 is a perspective view of the housing portion of the cosmetic powder dose dispenser of FIG. 16.

The housing 12, which is depicted apart in FIGS. 19 and 22, can be made of rigid material, such as molded plastic or metal. The housing 12 in this example is round with a concave interior for receiving a filter insert 20. A pair of curved slots 22 is disposed in opposition in the bottom of the housing 12. As shown in FIG. 22, the inner portion of the housing 12 can include an annular track 44. A raised semicircular ridge 28 with first and second ends separated by an open arc runs along the upper annular edge of the housing 12. A locking protuberance 30 is disposed adjacent to a first end of the open arc adjacent to an end of the ridge 28.

Figure 23:
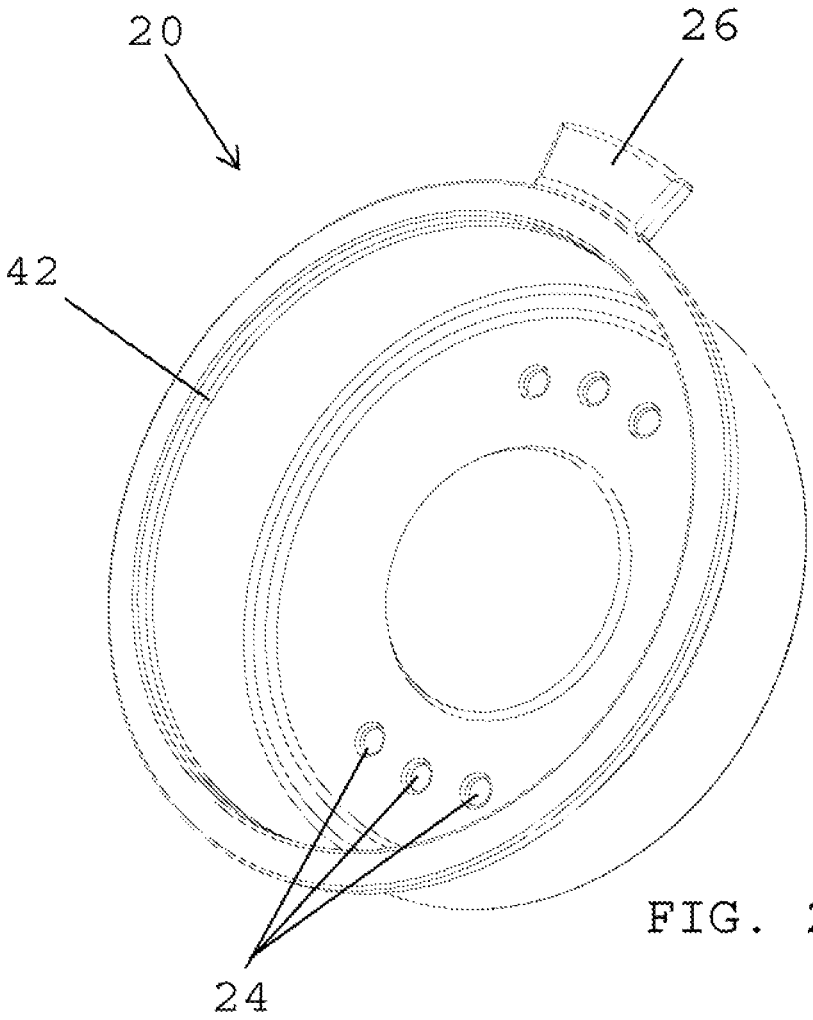
FIG. 23 is a perspective view of the sifter insert portion of the cosmetic powder dose dispenser of FIG. 16.
Figure 24:
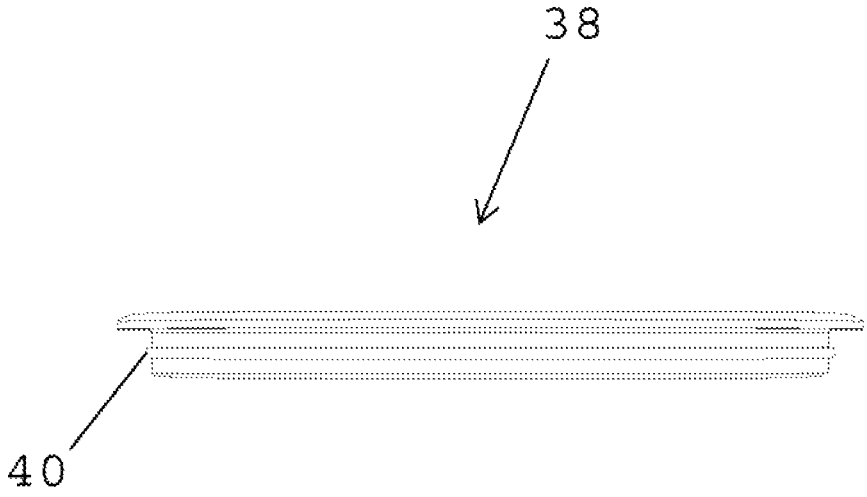
FIG. 24 is a view in front elevation of the top cap of the cosmetic powder dose dispenser of FIG. 16.

A sifter insert 20 is received into the open inner volume of the housing 12. As shown alone in FIGS. 23 and 25, the sifter insert 20 has an outer configuration corresponding in shape and size to permit its reception into the housing 12 in a close mating relationship. The insert 20 can in certain embodiments be made of the same rigid material as the housing 12.

A plurality of sifting apertures 24 are disposed in the bottom portion of the insert 20. In this embodiment, first and second groups of three sifting apertures 24 are disposed in arcuate dispositions in opposition in the bottom of the insert 20. It will be appreciated that the number, shape, size, and configuration of the sifting apertures 24 can be varied within the scope of the invention depending on, among other things, the type of cosmetic material to be dispensed and the desired flow of product.

Figure 25:
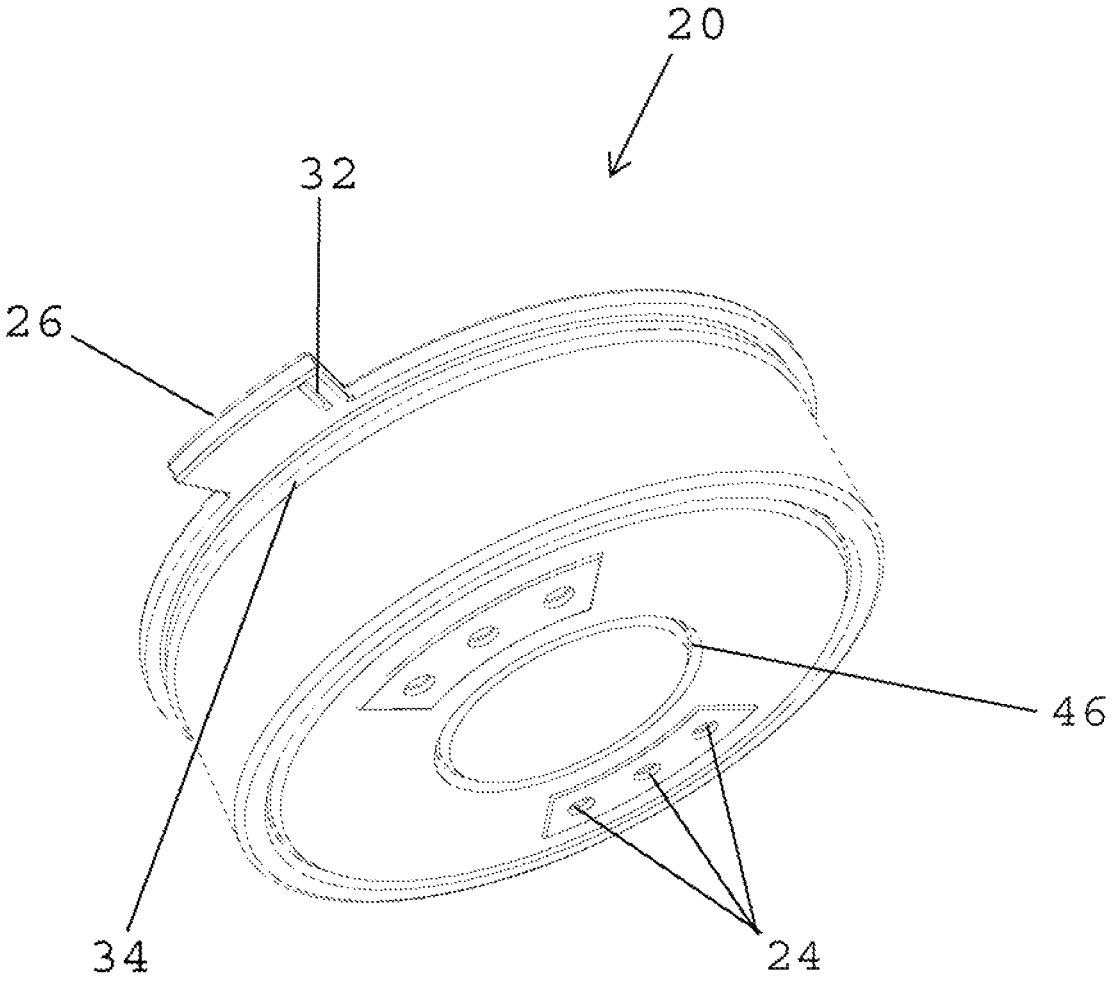
FIG. 25 is an alternative perspective view of the sifter insert portion of the cosmetic dose dispenser of FIG. 16.

As shown in FIG. 25, the sifter insert 20 can contain a concentric, circular indentation 46 in the bottom surface thereof. When the sifter insert 20 is disposed inside the housing 12, the circular notched track 44 of the housing 12 is received into the indentation 46. The track 44 and indentation 46 cooperate to guide the sifter insert 20 in pivoting smoothly relative to the housing 12.

A sifter lever 26 extends radially from an upper peripheral edge of the sifter insert 20. When the sifter insert 20 is disposed in the housing 12, the lever 26 rides on the upper annular edge of the housing 12 within the open arc between the ends of the semicircular ridge 28. As seen in FIG. 25, the lever 26 has a notch 32 in the lower surface thereof for selectively engaging the locking protuberance 30. With this, the sifter lever 26 can slide freely along the open arc between the ends of the semicircular ridge 28 and the sifter insert 20 can pivot freely within the housing 12 until the protuberance 30 engages the notch 32 thereby to retain the sifter insert 20 against inadvertent pivoting.

It will be appreciated, of course, that other means could be provided for enabling a selective pivoting of the sifter insert 20. By way of example and not limitation, the sifter insert 20 could have an annular peripheral flange, whether continuous or not, that projects outboard of the sifter insert 20 to be gripped by a user to permit a selective rotation of the sifter insert 20. Where included, the sifter lever 26 could pursue a wide variety of alternative shapes and configurations within the scope of the invention.

As seen in FIG. 25, the sifter insert 20 has a peripheral ridge 34 encircling the upper portion of the peripheral wall thereof for engaging the sifter insert 20 with a correspondingly located annular channel 36 on the inner surface of the peripheral wall of the housing 12, which can be seen in FIG. 22. Under this arrangement, the sifter insert 20 can be positively engaged with the housing 12 in a snap-fit engagement.

A round cap 38, which can be transparent, can be retained on top of the sifter insert 20 as shown in FIG. 1. The cap 38 has a peripheral ridge 40 for locking the cap 38 into place relative to a correspondingly located annular channel 42 on the inner surface of the peripheral wall of the sifter insert 20. The cap 38 can thus be positively engaged with the sifter insert 20 by a snap-fit engagement between the ridge 40 and the channel 42.

To assemble the powder dispenser 10, the cup 14 can be threadedly engaged with the bottom of the housing 12. The sifter insert 20 can be placed into the housing 12 and pushed down to snap the insert 20 into place with the sifter lever 26 disposed in the open arc between the ends of the semicircular ridge 28 on the upper edge of the housing 12. If desired, the protuberance 30 can be engaged with the notch 32 to retain the sifter insert 20 against inadvertent pivoting. Cosmetic powder or potentially some other product can be disposed in the insert 20 prior to sale of the dispenser 10 or additionally or alternatively by a user, and the cap 38 can be snapped in place relative to the sifter insert 20 to retain the cosmetic powder. When the sifter lever 26 is so positioned, the sifting apertures 24 can be disposed entirely out of alignment with the slots 22 so that cosmetic powder will be prevented from being dispensed.

With the powder dispenser 10 so assembled, the sifter lever 26 can be selectively slid from the first end of the arc thereby to bring the sifting apertures 24 in the sifter insert 20 into at least partial alignment with the slots 24 in the housing 12. Powder product can thus be sifted through the apertures 24 of the insert 20, through the slots 22 of the housing 12, and into the inner volume 16 of the cup 14 to yield a dose of cosmetic product. Then, a user can access the dose of cosmetic powder simply by unscrewing the cup 14 from the housing 12.

With certain details of the present invention for a cosmetic powder dose dispenser disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. A rotationally controlled cosmetic powder dose dispenser for dispensing powdered cosmetic in a controlled manner, the cosmetic powder dose dispenser comprising:

a sifter housing with a bottom wall and a peripheral wall;

a sifter cup pivotally retained by the sifter housing wherein the sifter cup has a bottom wall and a peripheral wall that cooperate to define an open inner volume for retaining a volume of cosmetic powder;

at least one aperture disposed in the bottom wall of the sifter housing and at least one aperture disposed in the bottom wall of the sifter cup wherein the at least one aperture in the bottom wall of the sifter cup can be selectively disposed in alignment with the at least one aperture in the bottom wall of the sifter housing to permit a volume of cosmetic powder to be dispensed from the open inner volume of the sifter cup and wherein the at least one aperture in the bottom wall of the sifter cup can be selectively disposed out of alignment with the at least one aperture in the bottom wall of the sifter housing to prevent cosmetic powder from being dispensed from the open inner volume of the sifter cup; and a sifter jar removably coupled to the sifter housing wherein the sifter jar has an open inner volume for receiving cosmetic powder dispensed from the open inner volume of the sifter cup;

a cap and means for selectively engaging the cap with the sifter cup in a closed configuration;

wherein the sifter housing has a shoulder ring that projects radially from a mid-portion of the peripheral wall and an outer cylindrical wall that projects from the outer edge of the shoulder ring to define an outer peripheral wall surface of the cosmetic powder dose dispenser and to define a torroidal shape between the outer cylindrical wall and the peripheral wall of the sifter housing, wherein the sifter jar has an annular rim received into the torroidal shape, and wherein the sifter housing, the sifter cup, the sifter jar, and the cap are configured with the outer cylindrical wall of the of the sifter housing defining an exposed external surface that may be touched and actuated by a user to permit a volume of cosmetic powder to be dispensed from the open inner volume of the sifter cup or to prevent cosmetic powder from being dispensed from the open inner volume of the sifter cup including when the sifter housing, the sifter cup, the sifter jar, and the cap are assembled and in the closed configuration.

2. The cosmetic powder dose dispenser of claim 1 wherein a plurality of apertures are disposed in the bottom wall of the sifter cup and a plurality of apertures are disposed in the bottom wall of the sifter housing wherein the pluralities of apertures in the bottom walls of the sifter cup and the sifter housing can be selectively disposed in alignment.

3. The cosmetic powder dose dispenser of claim 1 wherein the at least one aperture in the bottom wall of the sifter housing defines an arcuate configuration and wherein the at least one aperture in the bottom wall of the sifter cup defines an arcuate configuration disposed to align selectively with the arcuate configuration of the at least one aperture in the bottom wall of the sifter housing.

4. The cosmetic powder dose dispenser of claim 3 wherein the at least one aperture in one of the sifter housing and the sifter cup comprises a series of apertures disposed in an arcuate configuration and wherein the at least one aperture in the other of the sifter housing and the sifter cup comprises an arcuate slot.

5. The cosmetic powder dose dispenser of claim 4 wherein the series of apertures are disposed in the bottom wall of the sifter cup and wherein the arcuate slot is disposed in the bottom wall of the sifter housing.

6. The cosmetic powder dose dispenser of claim 5 wherein there are first and second slots disposed in the bottom wall of the sifter housing and first and second series of apertures in the bottom wall of the sifter cup wherein the first and second slots are disposed to align selectively with the first and second series of apertures in response a relative pivoting between the sifter cup and the sifter housing.

7. The cosmetic powder dose dispenser of claim 1 wherein the sifter jar is threadedly engaged with the sifter housing.

8. The cosmetic powder dose dispenser of claim 7 wherein the sifter housing has an annular ridge, wherein the sifter cup has a sifter rim defined by a radially communicating ring and a downturned outer cylindrical wall generally concentric with the peripheral wall of the sifter cup to define a torroidal shape, and wherein the annular ridge of the sifter housing is received into the torroidal shape defined by the outer cylindrical wall of the sifter cup and the peripheral wall of the sifter cup.

9. The cosmetic powder dose dispenser of claim 1 wherein the sifter cup is pivotable from a first orientation position to a second orientation position relative to the sifter housing and further comprising a means for limiting pivoting of the sifter cup from pivoting beyond the first and second positions.

10. The cosmetic powder dose dispenser of claim 9 wherein the at least one aperture in the bottom wall of the sifter housing defines an arcuate configuration, wherein the at least one aperture in the bottom wall of the sifter cup defines an arcuate configuration disposed to align selectively with the arcuate configuration of the at least one aperture in the bottom wall of the sifter housing, wherein the at least one aperture in the bottom wall of the sifter housing and the at least one aperture in the bottom wall of the sifter cup have a lead end and a trailing end and span a given arc length.

11. The cosmetic powder dose dispenser of claim 10 wherein the at least one aperture in one of the sifter housing and the sifter cup comprises an arcuate slot and wherein the means for limiting pivoting of the sifter cup comprises a stop member that projects from the other of the sifter housing and the sifter cup into the arcuate slot.

12. The cosmetic powder dose dispenser of claim 10 wherein the at least one aperture in one of the sifter housing and the sifter cup comprises a series of apertures disposed in an arcuate configuration with an arc length, wherein the at least one aperture in the other of the sifter housing and the sifter cup comprises an arcuate slot with an arc length, and wherein the arcuate slot has an arc length greater than the arc length of the series of apertures.

* * * * *